United States Patent [19]

Henschel

[11] 4,451,935

[45] Jun. 5, 1984

[54] HEAD COVERING EQUIPPED WITH DOUBLE POCKET

[76] Inventor: Edward W. Henschel, 13966 Meursalt Dr., Chesterfield, Mo. 63017

[21] Appl. No.: 376,594

[22] Filed: May 10, 1982

[51] Int. Cl.[3] ..... A42C 5/00

[52] U.S. Cl. ..... 2/185 R; 2/199; 2/195; 2/181; 2/253; 2/247

[58] Field of Search ..... 2/199, 195, 185 R, 181, 2/182.1, 209.1, 247, 249, 250, 251, 253

[56] References Cited

U.S. PATENT DOCUMENTS

| | | | |
|---|---|---|---|
| 160,404 | 10/1950 | Levine | 2/199 |
| 1,597,558 | 8/1926 | Walters | 2/181 |
| 1,618,418 | 2/1927 | Fields | 2/253 |
| 1,678,198 | 7/1928 | Rehder | 2/185 R |
| 2,439,984 | 4/1948 | Pearson | 2/181 |
| 2,486,584 | 11/1949 | Yagodnik | 2/253 |
| 2,615,168 | 11/1952 | Tannenbaum | 2/199 |

OTHER PUBLICATIONS

Gershman, *Journal of A.M.A.* vol. 168, No. 7, "Self-Adhering Nylon Tapes" Oct. 19, 1958, p. 980.

*Primary Examiner*—Werner H. Schroeder
*Assistant Examiner*—Mary A. Ellis
*Attorney, Agent, or Firm*—Rogers, Eilers & Howell

[57] ABSTRACT

A first wall and a second wall coact with a portion of a head covering section of a head covering to define an inner pocket and an outer pocket. The first wall is taller than the second wall to define a flap-forming portion; and a fold in that first wall permits that flap-forming portion to be moved outwardly over and downwardly below the level of the upper edge of the second wall to block the entrance to the outer pocket. That fold has a curved configuration in plan view so it tends to hold the flap-forming portion adjacent the outer face of the second wall as long as that fold exists. When the flap-forming portion is moved upwardly away from the outer face of the second wall to a position wherein it is generally in register with the lower portion of the first wall, a curved configuration of that lower portion of the first wall will resist movement of that flap-forming portion outwardly over and downwardly below the level of the upper edge of the second wall. Also, when the flap-forming portion is moved upwardly away from the outer face of the second wall to a position wherein it is generally in register with the lower portion of the first wall, that flap-forming portion will effectively block the entrance to the inner pocket and thereby prevent any accidental introduction of objects into that inner pocket.

12 Claims, 5 Drawing Figures

HEAD COVERING EQUIPPED WITH DOUBLE POCKET

BACKGROUND OF THE INVENTION

Some articles of wearing apparel, such as trousers, slacks, shorts, vests, jackets, topcoats and overcoats, are traditionally equipped with pockets. In addition, some shoes and some caps have been equipped with pockets.

SUMMARY OF THE INVENTION

The present invention forms an inner pocket for a head covering by disposing an inner wall in register with a portion of that head covering, and forms an outer pocket by disposing an outer wall in register with the inner wall. That inner wall is taller than the outer wall—to provide a flap-forming portion and a fold which helps define that flap-forming portion and which is close to the level of the upper edge of the outer wall to permit that flap-forming portion to be moved outwardly beyond and then downwardly below the level of that upper edge. That fold has a curved configuration in plan view; and it will tend to hold the flap-forming portion adjacent the outer surface of the outer wall. It is, therefore, an object of the present invention to provide an inner wall and an outer wall which coact with a head covering to define an inner pocket and an outer pocket, and also to provide that inner wall with a curved-configuration fold therein which will tend to hold a flap-forming portion of that inner wall close to the outer surface of that outer wall.

When the flap-forming portion of the inner wall is moved upwardly and away from the outer surface of the outer wall and is moved into generally-vertical registry with the lower portion of that inner wall, the fold will disappear; and the portion of that inner wall, which normally has the fold therein, will have a curved configuration in plan view which will be generally complementary to the plan view curved configuration of the portion of the head covering. The curved configuration of that portion of the inner wall will resist movement of the flap-forming portion outwardly beyond and downwardly below the level of the upper edge of the outer wall; and hence, whenever the flap-forming portion is moved upwardly to a position wherein it is in generally-vertical registry with the lower portion of that inner wall, it will tend to stay in that position. It is, therefore, an object of the present invention to provide a wall which has a fold therein and a flap-forming portion thereon and which will tend to hold that flap-forming portion in raised position when that fold disappears as that flap-forming portion is moved to that raised position.

When the flap-forming portion of the inner wall is in its raised position, it will effectively block the entrance to the inner pocket while providing full access to the outer pocket. However, when that flap-forming portion is adjacent the outer surface of the outer wall, it will fully block the entrance to the outer pocket while providing full and ready access to the inner pocket. It is, therefore, an object of the present invention to provide an inner wall and an outer wall which coact with a head covering to define an inner pocket and an outer pocket; and also to provide a flap-forming portion which can be moved to a raised position wherein it will fully block the entrance to the inner pocket while providing full access to the outer pocket, but also can be moved downwardly to a lower position wherein it will fully block the entrance to the outer pocket while permitting full access to the inner pocket.

The portion of the head covering adjacent the inner pocket is convex in a vertical transverse plane; and the fold in the inner wall, which helps define the flap-forming portion, also is convex in that vertical transverse plane. That convex configuration of the head covering coacts with that convex configuration of that fold to define a flared-mouth opening for the inner pocket, and thereby facilitates the insertion of objects into that inner pocket. It is, therefore, an object of the present invention to form a pocket for a head covering which has the entrance thereof defined by two diverging convex surfaces.

The portion of the head covering adjacent which the inner and outer pockets are located has a curved configuration in plan view. The walls of the inner and outer pockets tend to have complementary curved configurations; and the resulting curved configurations of the inner and outer pockets enable those pockets to apply forces to flat objects therewithin which tend to resist accidental separation of those flat objects from those pockets. It is, therefore, an object of the present invention to provide an inner pocket and an outer pocket for a head covering which have curved configurations in plan view to enable those pockets to resist accidental removal of flat objects from those pockets.

The portion of the head covering which helps define the inner pocket is flexible; and the walls which help define the inner and outer pockets also are flexible. The combined flexibilities of that portion of the head covering and of those walls enable the head covering to be worn even though objects are held in each of the inner and outer pockets. It is, therefore, an object of the present invention to provide a head covering with an inner wall and an outer wall in register with a portion of that head covering, and to have that portion and those walls flexible to enable that head covering to be worn while objects are held in both the inner and outer pockets.

The head covering provided by the present invention has a sweat band; and it has the inner and outer pockets thereof arranged so the bottoms thereof can tilt, but not move appreciable distances transversely, relative to that sweat band. The upper portions of those pockets are tiltable and transversely movable relative to that sweat band. As a result, the upper portions of the inner and outer pockets can be tilted and also can be moved transversely of the headband, even though that headband is solidly seated on a wearer's head. It is, therefore, an object of the present invention to provide a head covering with a sweat band and to prevent transverse movement of the bottoms of inner and outer pockets relative to that sweat band while permitting tilting and transverse movement of the upper portions of those pockets relative to that sweat band.

The flap-forming portion has part of a flap-holding means positioned thereon but spaced outwardly from the fold which helps define that flap-forming portion; and the outer wall of the outer pocket has the other part of that flap-holding means positioned thereon but spaced below the level of that fold. Consequently, whenever those parts of that flap-holding means coact to hold the flap-forming portion adjacent the outer wall of the outer pocket, the fold will be flexible so it can respond to forces, which are applied to it by an object which is being inserted into the inner pocket, to move a short distance outwardly from the head covering. That movement locally expands the flared-mouth entrance of that inner pocket before the rest of the inner wall can be moved away from the head covering as the object is pushed into that inner pocket. It is, therefore, an object of the present invention to provide a flap-forming portion with part of a flap-holding means thereon, to provide an outer wall of an outer pocket with the other part of that flap-holding means thereon, and to space those parts from a fold so that fold can readily respond, to engagement by an object being inserted in an inner pocket, to move transversely away from the head covering and thereby locally expand the flared-mouth entrance for that inner pocket before the upper portion of the inner wall need be moved away from the head covering.

Other and further objects and advantages of the present invention should become apparent from an examination of the drawing and accompanying description.

In the drawing and accompanying description a preferred embodiment of the present invention is shown and described but it is understood that the drawing and accompanying description are for the purpose of illustration only and do not limit the invention and that the invention will be defined by the appended claims.

DETAILED DESCRIPTION OF PREFERRED EMBODIMENT

Figure 1:
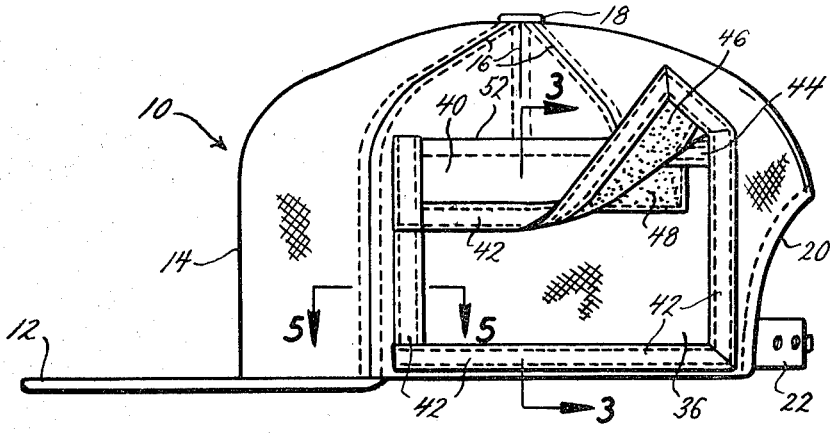
FIG. 1 is a side elevational view of a cap which is equipped with a double pocket and which is made in accordance with the principles and teachings of the present invention.
Figure 5:
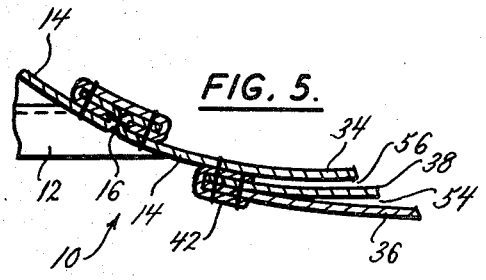
FIG. 5 is a sectional view, on the scale of FIG. 3, which is taken along the plane indicated by a line 5—5 in FIG. 1.

Referring to the drawing in detail, the numeral 10 generally denotes a cap which has a bill 12 and a head-covering section 14 which is composed of six generally-triangular sections that are interconnected by seams 16. A button 18 is secured to the junctions of the six sections and of the seams 16. The numeral 20 denotes a cutaway portion at the rear of the cap; and the numeral 22 denotes an adjustable strap which spans that cutaway portion. As shown particularly by FIG. 3, the lower edges of the six generally-triangular panels are bent inwardly of, and then upwardly along the inner surfaces of, a stiffener 26; and folds 24 which are adjacent those lower edges are contiguous, and they continuously underlie and conceal the lower edge of that stiffener. The numeral 28 denotes a sweat band which has a lining 30. As shown particularly by FIG. 3, a row of stitching 32 fixedly secured the lower edge of the sweat band 28 and of its lining 30 to the inwardly and upwardly folded portions of the six generally-triangular panels and also to the stiffener 26. However, that row of stitching does not extend through to the outer surface of the head-covering section 14; and hence the sweat band 28, its lining 30, the inwardly and upwardly folded portions of the generally-triangular sections, and the stiffener 26 can be tilted relative to the head-covering section 14.

The bill 12, the head-covering section 14, the six generally-triangular panels and the seams 16 which define that head-covering section, the button 18, the cutaway-portion 20, and the adjustable strap 22 are standard and usual parts of a cap and are not, per se, parts of the present invention. Similarly, the fold 24, the stiffener 26, the sweat band 28, the lining 30, and the row of stitching 32 are standard and usual parts of a cap and are not, per se, parts of the present invention.

The numeral 34 denotes a portion of the head-covering section 14 which has an outer wall 36 of generally-rectangular configuration disposed in register with it. The numeral 38 denotes an inner wall which has the lower portion thereof interposed between the outer wall 36 and the portion 34 of the head-covering section 14. As indicated particularly by FIGS. 1–4, the height of the inner wall 38 is substantially greater than the height of the outer wall 36. The numeral 40 denotes a flap-forming portion of the inner wall 38; and a fold 52 is intermediate the lower portion and the flap-forming portion 40 of wall 38, and it tends to help define that flap-forming portion. The wall 38 is generally rectangular; and it has a width that is substantially equal to the width of the outer wall 36.

Edge-binding tape 42 encloses and conceals the bottom edges of the walls 36 and 38, the side edges of those walls, and the top edge of the inner wall 38. A similar edge-binding tape 44 encloses and conceals the upper edge of the outer wall 36. The edge-binding tape 42 is secured to the bottoms and to the sides of the inner and outer walls 38 and 36 and also to the upper edge of the wall 38 by two rows of stitching 50. Those bottoms, the sides of wall 36, and the lower portions of the sides of wall 38 are secured to the head-covering section 14 by those rows of stitching. As indicated by FIG. 3, the walls 38 and 36 preferably are made wide enough and deep enough so the rows of stitching 50 pass through the sides and bottoms of those walls.

The numeral 46 denotes the hook-equipped section of a length of a flap-holding means which is sold under the mark Velcro; and that section is stitched to that face of the flap-forming portion 40 which can confront the outer surface of the outer wall 36. The numeral 48 denotes the pad section of that length of that flap-holding means; and that section is secured to the upper portion of the outer surface of the outer wall 36. As shown particularly by FIGS. 3 and 4, the hook-like section 46 is spaced from the fold 52, and the pad section 48 is spaced below that fold; and hence that fold is readily flexible.

The portion 34 and the inner wall 38 coact to define an inner pocket 56, and that inner wall and the outer wall 36 coact to define an outer pocket 54. The head-covering section 14, the inner wall 38 and the outer wall 36 can be made of fabric, either woven or non-woven, plastic, plastic impregnated cloth, plastic impregnated paper, or other suitable materials which are known to those skilled in the art of making head coverings. The portion 34 and the inner wall 38 are readily flexible so they can yield to permit the insertion of objects of different thicknesses into the inner pocket 56. Similarly, the inner wall 38 and the outer wall 36 are readily flexible so they can yield to permit the insertion of objects of different thicknesses into the outer pocket 54. The flexibilities of the portion 34, of the inner wall 38, and of the outer wall 36 are great enough so the cap 10 can be worn with comfort even though each of the inner and outer pockets has an object therein.

Figure 3:
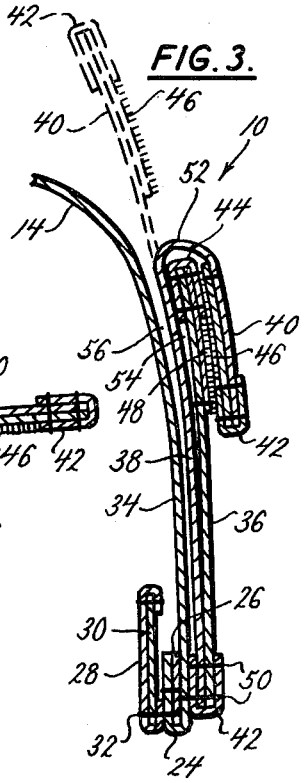
FIG. 3 is a sectional view, on a larger scale, which is taken along the plane indicated by the line 3—3 in FIG. 1 and which shows two positions for a flap-forming portion.

As shown particularly by FIG. 3, the row of stitching 32 does not extend through the portions of the six generally-triangular panels of head-covering section 14 which are disposed outwardly of the folds 24; and the rows of stitching 50 do not extend into the stiffener 26. As a result, the bottoms of the portion 34, of the inner wall 38, and of the outer wall 36—and hence of the inner and outer pockets 56 and 54 as well—can tilt outwardly relative to the user's head, even when the sweat band 28 is solidly seated on the user's head. The upper parts of the portion 34, of the inner wall 38, and of the outer wall 36—and hence of the inner and outer pockets 56 and 54 as well—can move transversely, as well as tilt outwardly, relative to the user's head, even when the sweat band 28 is solidly seated on the user's head. Consequently, objects of different sizes and configurations can be carried within the pockets 54 and 56 while the cap 10 is being worn.

Because the hook-like section 46 of the flap-holding means is spaced from the fold 52, and because the pad-like section 48 of that flap-holding means also is spaced from that fold, that fold can respond to an effort to introduce an object into the inner pocket 56 to move transversely away from the portion 34 before any part of the lower portion of the inner wall 38 or any part of the flap-forming portion 40 must be moved transversely away from the portion 34 to accommodate the inserted object. In this way, the fold 52 facilitates quick and easy local expansion of the entrance to the inner pocket as an object is being introduced into that pocket.

As indicated particularly by FIG. 3, the part of the head-covering section 14 which helps define the entrance to the inner pocket 56 is convex, and the part of the fold 52 which helps define that entrance also is convex. Further, the convex configurations of the portion 34 and of the fold 52 diverge to make the entrance to the inner pocket 56 a flared-mouth entrance; and such an entrance facilitates ready insertion of objects into that inner pocket even while the cap 10 is being worn. The previously-mentioned local expansion of the entrance to the inner pocket additionally facilitates ready insertion of objects into the inner pocket while the cap 10 is being worn.

Figure 2:
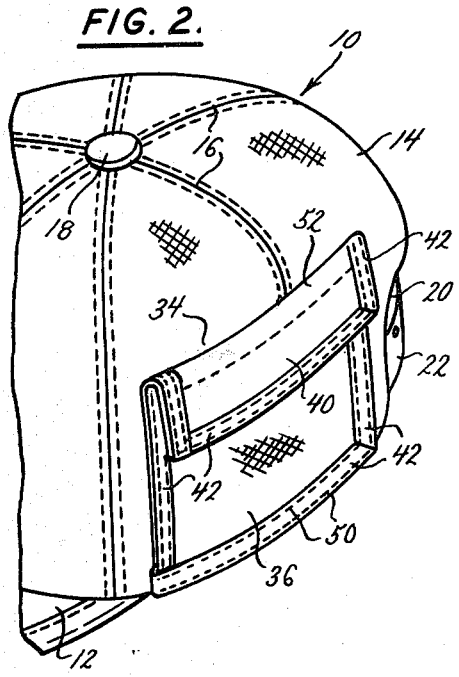
FIG. 2 is a perspective view of part of the cap of FIG. 1.
Figure 4:
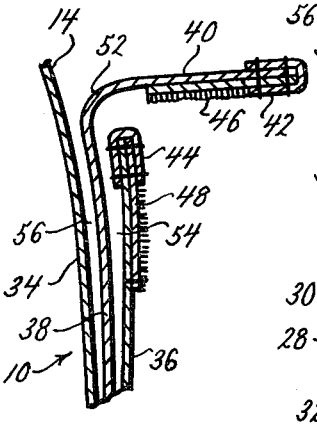
FIG. 4 is a sectional view, on the scale of FIG. 3, which is taken along the plane indicated by the line 3—3 in FIG. 1 and which shows the flap-forming portion intermediate the positions of FIG. 3.

As shown particularly by FIG. 2, the portion 34 of the head-covering section 14 has a convex configuration in plan view, and the fold 52 has a complementary curved configuration. The latter curved configuration will, as long as the fold 52 is permitted to exist, tend to cause the fold-forming portion 40 to have an arcuate configuration and to position itself adjacent the outer face of the outer wall 36. This is desirable; because it will enable that fold-forming portion, and the section of inner wall 38 which contains the fold 52, to coact to effectively block the entrance to the outer pocket 54—even if the user forgets to press the hook-like section 46 into holding engagement with the pad section 48 of the flap-holding means. Further, the arcuate configuration of the fold 52 will tend to urge the flap-forming portion 40 downwardly toward the outer face of the outer wall 36, and thereby prevent accidental movement of objects out of the outer pocket 54, even where the fold-forming portion is raised to the generally-horizontal position indicated by FIG. 4.

Whenever the fold-forming portion 40 is moved to the raised dotted-line position of FIG. 3, wherein it is generally in vertical registry with the lower part of the inner wall 38, the fold 52 will disappear. At such time, the section of the wall 38, in which the fold 52 normally is located, will have a curved configuration in plan view which is complementary to the curved configuration of the portion 34 of head-covering section 14. That curved configuration of that section of inner wall 38 will tend to hold the flap-forming portion 40 in the raised dotted-line position of FIG. 3, and also to resist accidental movement of that flap-forming portion outwardly and downwardly toward the solid line position of FIG. 3.

As long as the fold-forming portion 40 and the section of the inner wall 38, in which the fold 52 is located, are in the dotted-line position of FIG. 3, they will effectively block the entrance to the inner pocket 56 while fully exposing the entrance to the outer pocket 54. This is desirable; because it not only facilitates the introduction of objects into that outer pocket, but it prevents accidental insertion of objects into that inner pocket—without any need of applying a force to the fold-forming portion 40 to hold that fold-forming portion in that dotted-line position.

The inner wall 38 will tend to assume a plan view curved configuration which is complementary to the plan view convex configuration of the portion 34 of the head-covering section 14. Similarly, the outer wall 36 will tend to assume a plan view curved configuration which is complementary to the plan view curved configuration of the inner wall 38. Those plan view curved configurations of those walls will enable those walls to apply holding forces to flat objects within the inner pocket 56 and within the outer pocket 54. Those holding forces are desirable, because they will prevent accidental movement of flat objects out of the inner pocktet 56 or out of the outer pocket 54.

Whereas the drawing and accompanying description have shown and described a preferred embodiment of the present invention, it should be apparent to those skilled in the art that various changes may be made in the form of the invention without affecting the scope thereof.

What I claim is:

1. A head covering which is equipped with a double pocket and which comprises a head-covering section, a wall that is disposed in register with a portion of said head-covering section and that coacts with said portion of said head-covering section to help define an inner pocket, a second wall that is disposed in register with the first said wall and that coacts with said first said wall to help define an outer pocket, said first said wall having the bottom and sides thereof immediately adjacent the bottom and sides of said portion of said head-covering section to complete said inner pocket, said second wall having the bottom and sides thereof immediately adjacent the bottom and sides of said first said wall to complete said outer pocket, said portion of said head-covering section having a curved configuration in plan view, said first said wall being taller than said second wall to provide a flap-forming portion at the free edge of said first said wall which can be moved upwardly to a position wherein it effectively blocks the entrance to said inner pocket or which can be moved downwardly to a second position wherein it effectively blocks the entrance to said outer pocket, and a fold in said first said wall which is adjacent the level of the upper edge of said second wall and which helps define said flap-forming portion of said first said wall and which enables said flap-forming portion to be moved outwardly over and downwardly below the level of said upper edge of said second wall to said second position, said flap-forming portion having both side edges thereof free to move toward and away from said first wall and also toward and away from said portion of said head-covering section and said fold having a curved configuration in plan view which is generally complementary to said curved configuration of said portion of said head-covering section, whereby said fold tends to hold said flap-forming portion of said first said wall adjacent the outer face of said second wall as long as said fold is permitted to remain in said first said wall.

2. A head covering as claimed in claim 1 wherein said fold tends to provide a curved configuration for said flap-forming portion of said first said wall whenever said flap-forming portion is adjacent said outer face of said second wall, wherein the section of said first said wall which normally has said fold therein will have a curved configuration in plan view which is generally complementary to said curved configuration of said portion of said head-covering section whenever said flap-forming portion is moved upwardly and away from said outer face of said second wall to said second position and is disposed in generally-vertical alignment with the part of said first said wall that is intermediate said second wall and said portion of said head-covering section, whereby said section of said first said wall which normally has said fold therein will resist accidental movement of said flap-forming portion outwardly over and downwardly below the level of said upper edge of said second wall until said fold is reestablished in said section of said first said wall.

3. A head covering as claimed in claim 1 wherein said portion of said head-covering section is convex in a vertical transversely-directed plane, wherein said fold has an opposite convex configuration in said vertical transversely-directed plane, and wherein the convex configurations for said portion of said head-covering section and for said fold will automatically diverge and thereby coact to provide a flared-mouth entrance for said inner pocket with curved surfaces at both sides thereof whenever said flap-forming portion of said first said wall is folded to extend outwardly over and downwardly below the level of said upper edge of said second wall to said second position to serve as a closure for said outer pocket.

4. A head covering as claimed in claim 1 wherein said section of said first said wall which normally has said fold therein and also has said flap-forming portion will extend a substantial distance above the level of said upper edge of said second wall whenever said flap-forming portion is moved upwardly and away from said outer face of said second wall to the first said position and hence is disposed in generally-vertical alignment with the part of said first said wall that is intermediate said second wall and said portion of said head-covering section, whereby said section of said first said wall which normally has said fold therein and said flap-forming portion will effectively block said entrance to said inner pocket, and thereby prevent accidental insertion of objects into said inner pocket, whenever said flap-forming portion is moved upwardly and away from said outer face of said second wall to said first said position and is disposed in generally-vertical alignment with the part of said first said wall that is intermediate said second wall and said portion of said head-covering section.

5. A head covering which is equipped with a double pocket and which comprises a head-covering section, a wall that is disposed in register with a portion of said head-covering section and that coacts with said portion of said head-covering to help define an inner pocket, a second wall that is disposed in register with the first said wall and that coacts with said first said wall to help define an outer pocket, said first said wall having the bottom and sides thereof immediately adjacent the bottom and sides of said portion of said head-covering section to complete said inner pocket, said second wall having the bottom and sides thereof immediately adjacent the bottom and sides of said first said wall to complete said outer pocket, said first said wall being taller than said second wall to provide a flap-forming portion at the free edge of said first wall, a fold in said first said wall which is adjacent the level of the upper edge of said second wall and which helps define said flap-forming portion, said first said wall being taller than said second wall to provide a flap-forming portion at the free edge of said first said wall which can be moved upwardly to a position wherein it effectively blocks the entrance to said inner pocket; said flap-forming portion extending a substantial distance above the level of said upper edge of said second wall whenever said flap-forming portion is moved upwardly and away from the outer face of said second wall to the first said position so said section of said first said wall that normally has said fold therein and said flap-forming portion will effectively block said entrance to said inner pocket and will thereby prevent accidental insertion of objects into said inner pocket, said first said wall being flexible and said portion of said head-covering section being flexible to enable said inner pockets to accommodate objects of differing thicknesses, said second wall also being flexible and coacting with said first said wall to enable said outer pocket to accommodate objects of differing thicknesses, and the flexibility of said first said wall and the flexibility of said second wall coacting with the flexibility of said portion of said head-covering section to enable said head covering to be worn while each of said inner and outer pockets is holding at least one object.

6. A head covering which is equipped with a double pocket and which comprises a head-covering section, a wall that is disposed in register with a portion of said head-covering section and that coacts with said portion of said head-covering section to help define an inner pocket, a second wall that is disposed in register with the first said wall and that coacts with said first said wall to help define an outer pocket, said first said wall having the bottom and sides thereof immediately adjacent the bottom and sides of said portion of said head-covering section to complete said inner pocket, said second wall having the bottom and sides thereof immediately adjacent the bottom and sides of said first said wall to complete said outer pocket, a sweat band, said portion of said head-covering section having said bottom thereof tiltable relative to but held against appreciable movement laterally away from said sweat band, said portion of said head-covering section having the top thereof and the upper portions of the sides thereof tiltable relative to and also being movable appreciable distances laterally relative to said sweat band, whereby the top and the upper portions of said inner pocket can be moved appreciable distances relative to the head of the wearer of said head covering to permit objects to be inserted into said inner pocket while said sweat band closely engages said head.

7. A head covering which is equipped with a double pocket and which comprises a head-covering section, a wall that is disposed in register with a portion of said head-covering section and that coacts with said portion of said head-covering section to help define an inner pocket, a second wall that is disposed in register with the first said wall and that coacts with said first said wall to help define an outer pocket, said first said wall having the bottom and side edges thereof immediately adjacent the bottom and sides of said portion of said head-covering section to complete said inner pocket, said second wall having the bottom and side edges thereof immediately adjacent the bottom and side edges of said first said wall to complete said outer pocket, said first said wall being taller than said second wall to provide a flap-forming portion at the free edge of said first said wall, a fold in said first said wall which is adjacent the level of the upper edge of said second wall and which helps define said flap-forming portion, said flap-forming portion being movable to a position wherein said section of said first said wall that normally has said fold therein and said flap-forming portion will effectively block said entrance to said inner pocket and will thereby prevent accidental insertion of objects into said inner pocket, said flap-forming portion being movable upwardly and away from said outer face of said second wall, said section of said first said wall that normally has said fold therein having a curved configuration in plan view, which is generally complementary to said curved configuration of said portion of said head-covering section, whenever said flap-forming portion is moved upwardly and away from said outer face of said second wall, whereby said section of said first said wall that normally has said fold therein will resist accidental movement of said flap-forming portion outwardly over and downwardly below the level of said upper edge of said second wall until said fold is reestablished in said section of said first said wall, said first said wall being flexible and said portion of said head-covering section being flexible to enable said inner pocket to accommodate objects of differing thicknesses, said second wall also being flexible and coacting with said first said wall to enable said outer pocket to accommodate objects of differing thicknesses, the flexibility of said first said wall and the flexibility of said second wall coacting with the flexibility of said portion of said head-covering section to enable said head covering to be worn while each of said first said and second pockets is holding at least one object, a sweat band, said portion of said head-covering section having said bottom thereof tiltable relative to but held against appreciable movement laterally away from said sweat band, said portion of said head-covering section having the top thereof and the upper portions of the sides therof tiltable relative to and also being movable appreciable distances laterally relative to said sweat band, whereby the top and the upper portions of said inner pocket can be moved appreciable distances relative to the head of the wearer of said head covering to permit objects to be inserted into said inner pocket while said sweat band closely engages said head.

8. A head covering which is equipped with a double pocket and which comprises a head-covering section, a wall that is disposed in register with a portion of said head-covering section and that coacts with said portion of said head-covering section to help define an inner pocket, a second wall that is disposed in register with the first said wall and that coacts with said first said wall to help define an outer pocket, said first said wall having the bottom and sides thereof immediately adjacent the bottom and sides of said portion of said head-covering section to complete said inner pocket, said second wall having the bottom and sides thereof immediately adjacent the bottom and sides of said first said wall to complete said outer pocket, said first said wall being taller than said second wall to provide a flap-forming portion at the free edge of said first said wall which can be moved upwardly to a position wherein it effectively blocks the entrance to said inner pocket or which can be moved downwardly to a second position wherein it effectively blocks the entrance to said outer pocket, and a fold in said first said wall which is adjacent the level of the upper edge of said second wall and which helps define said flap-forming portion and which enables said flap-forming portion to extend outwardly over and downwardly below the level of said upper edge of said second wall to effectively block the entrance to said outer pocket and thereby prevent accidental insertion of objects into and accidental removal of objects from said outer pocket, said flap-forming portion extending a substantial distance above the level of said upper edge of said second wall whenever said flap-forming portion is moved upwardly and away from said outer face of said second wall to the first said portion and hence is disposed in generally-vertical alignment with the part of said first said wall that is intermediate said second wall and said portion of said head-covering section, whereby said section of said first said wall which normally has said fold therein and said flap-forming portion wall effectively block the entrance to said inner pocket, and thereby prevent accidental insertion of objects into said inner pocket, whenever said flap-forming portion is moved upwardly and away from said outer face of said second wall and is disposed in generally-vertical alignment with the part of said first said wall that is intermediate said second wall and said portion of said head-covering section.

9. A head covering as claimed in claim 8 wherein said portion of said head-covering section is convex in a vertical transversely-directed plane, wherein said fold assumes an opposite convex configuration as said flap-forming portion is moved outwardly over and downwardly below the level of said upper edge of said second wall to said second position, and wherein the convex configuration for said portion of said head-covering section and for said fold will automatically diverge and thereby coact to provide a flared-mouth entrance for said inner pocket which has curved surfaces at each side thereof whenever said flap-forming portion of said first said wall is moved outwardly over and downwardly below the level of said upper edge of said second wall to said second position to serve as a closure for said outer pocket.

10. A head covering which is equipped with a double pocket and which comprises a head-covering section, a wall that is disposed in register with a portion of said head-covering section and that coacts with said portion of said head-covering section to help define an inner pocket, a second wall that is disposed in register with the first said wall and that coacts with said first said wall to help define an outer pocket, said first said wall having the bottom and sides thereof immediately adjacent the bottom and sides of said portion of said head-covering section to complete said inner pocket, said portion of said head-covering section being convex in a vertical transversely-directed plane, said fold assuming an opposite convex configuration in said vertical transversely-directed plane as said flap-forming portion is moved outwardly over and downwardly below the level of said upper edge of said second wall to said second position, said convex configurations for said portion of said head-covering section and for said fold automatically diverging and thereby coacting to provide a flared-mouth entrance for said inner pocket which has curved surfaces at each side thereof whenever sid flap-forming portion is moved outwardly over and downwardly below the level of said upper edge of said second wall to said second position to effectively block said entrance to said outer pocket, said fold having a curved configuration in plan view which is generally complementary to said curved configuration of said portion of said head-covering section whereby said fold tends to hold said flap-forming portion adjacent said outer face of said second wall as long as said fold is permitted to remain in said second position adjacent said first said wall, said section of said first said wal that normally has said fold therein having a curved configuration in plan view, which is generally complementary to said curved configuration of said portion of said head-covering section, whenever said flap-forming portion is moved upwardly and away from said outer face of said second wall, whereby said section of said first said wall that normally has said fold therein will resist accidental movement of said flap-forming portion outwardly over and downwardly below the level of said upper edge of said second wall until said fold is reestablished in said section of said first said wall, said second wall having the bottom and sides thereof immediately adjacent the bottom and sides of said first said wall to complete said outer pocket, said portion of said head-covering section having a curved configuration in plan view, and said first said wall tending to conform to said curved configuration of said portion of said head-covering section, whereby said portion of said head-covering section and said first said wall will coact to apply forces, to a flat object within said inner pocket, that will resist accidental movement of said flat object out of said inner pocket.

11. A head covering as claimed in claim 10 wherein said second wall tends to conform to the configuration of said first said wall and hence also tends to conform to said curved configuration of said portion of said head-covering section, whereby said portion of said head-covering section and said first said wall and said second wall will coact to apply forces to flat objects within both said inner and outer pockets that will resist accidental movement of said flat objects out of said inner and outer pockets.

12. A head covering which is equipped with a double pocket and which comprises a head-covering section, a wall that is disposed in register with a portion of said head-covering section and that coacts with said portion of said head-covering section to help define an inner pocket, a second wall that is disposed in register with the first said wall and that coacts with said first wall to help define an outer pocket, the first said wall having the bottom and sides thereof immediately adjacent the bottom and sides of said portion of said head-covering section to complete said inner pocket, said second wall having the bottom and sides thereof immediately adjacent the bottom and sides of said first said wall to complete said outer pocket, said first said wall being taller than said second wall to provide a flap-forming portion at the free edge of said first said wall which can be moved upwardly to a position wherein it overlies and blocks the entrance to said inner pocket or which can be moved downwardly to a second position wherein it effectively blocks the entrance to said outer pocket, a fold in said first said wall which is adjacent the level of the upper edge of said second wall and which helps define said flap-forming portion and which enables said flap-forming portion to be moved outwardly over and downwardly below the level of said upper edge of said second wall to said second position to effectively block said entrance to said outer pocket and thereby prevent accidental insertion of objects into and accidental removal of objects from said outer pocket, said flap-forming portion extending a substantial distance above the level of said upper edge of said second wall whenever said flap-forming portion is moved upwardly and away from the outer face of said second wall to the first said position and hence is disposed in generally-vertical alignment with the part of said first said wall which is intermediate said second wall and said portion of said head-covering section, whereby said section of said first said wall that normally has said fold therein and said flap-forming portion will effectively block said entrance to said inner pocket, and will thereby prevent accidental insertion of objects into said inner pocket, whenever said flap-forming portion is moved upwardly and away from said outer face of said second wall and is disposed in generally-vertical alignment with said part of said first said wall that is intermediate said outer wall and said portion of said head-covering section, said portion of said head-covering section being convex in a vertical transversely-directed plane, said fold assuming an opposite convex configuration as said flap-forming portion is moved outwardly over and downwardly below the level of said upper edge of said second wall to said second position, said convex configurations for said portion of said head-covering section and for said fold automatically diverging and thereby coacting to provide a flared-mouth entrance for said inner pocket which has curved surfaces at each side thereof whenever said flap-forming portion is moved outwardly over and downwardly below the level of said upper edge of said second wall to said second position to effectively block said entrance to said outer pocket, said portion of said head-covering section having a curved configuration in plan view, said first said wall tending to conform to said curved configuration of said portion of said head-covering section, said second wall tending to conform to the curved configuration of said first said wall and hence also to conform to said curved configuration of said portion of said head-covering section, whereby said portion of said head-covering section and said first said wall and said second wall will coact to apply forces, to flat objects within both said inner and outer pockets, which will resist accidental movement of said flat objects out of said inner and outer pockets, said fold having a curved configuration in plan view which is generally complementary to said curved configuration of said portion of said head-covering section, whereby said fold tends to hold said flap-forming portion adjacent said outer face of said second wall as long as said fold is permitted to remain in said second position adjacent said first said wall, said section of said first said wall that normally has said fold therein having a curved configuration in plan view, which is generally complementary to said curved configuration of said portion of said head-covering section, whenever said flap-forming portion is moved upwardly and away from said outer face of said second wall to said first said position and is disposed in generally-vertical alignment with said part of said first said wall which is intermediate said second wall and said portion of said head-covering section, whereby said section of said first said wall that normally has said fold therein will resist accidental movement of said flap-forming portion outwardly over and downwardly below the level of said upper edge of said second wall until said fold is reestablished in said section of said first said wall, said first said wall being flexible and said portion of said head-covering section being flexible to enable said inner pocket to accommodate objects of different thicknesses, said second wall also being flexible and coacting with said first said wall to enable said outer pocket to accommodate objects of different thicknesses, the flexibility of said first said wall and the flexibility of said second wall coacting with the flexibility of said portion of said head-covering section to enable said head covering to be worn while each of said inner and outer pockets is holding at least one object, a sweat band, said portion of said head-covering section having said bottom thereof tiltable relative to but held against appreciable movement laterally away from said sweat band, said portion of said head-covering section having the top thereof and the upper portions of the sides thereof tiltable relative to, and also being movable appreciable distances laterally relative to, said sweat band, whereby the top and the upper portions of said inner pocket can be moved appreciable distances relative to the head of the wearer of said head covering to permit objects to be inserted into said inner pocket while said sweat band closely engages said head, flap-holding means having part thereof positioned on said flap-forming portion so it is spaced outwardly from said fold, and said second wall having the rest of said flap-forming means positioned thereon so it is spaced below the level of said fold, whereby said fold can respond to an effort to introduce an object into said inner pocket to flex transversely away from a confronting part of said head-covering section and thereby locally enlarge said entrance to said inner pocket before any part of the lower portion of said first said wall or said flap-forming portion is moved transversely away from any part of said head-covering section.

* * * * *